US010188244B2

(12) United States Patent
Larsson et al.

(10) Patent No.: US 10,188,244 B2
(45) Date of Patent: Jan. 29, 2019

(54) DISPENSER AND METHOD OF REPLENISHING A DISPENSER

(71) Applicant: SCA Hygiene Products AB, Göteborg (SE)

(72) Inventors: Björn Larsson, Göteborg (SE); Per Möller, Borlänge (SE); David Sahlin, Göteborg (SE); Lars Thorén, Borlänge (SE)

(73) Assignee: ESSITY HYGIENE AND HEALTH AB, Göteborg (SE)

( * ) Notice: Subject to any disclaimer, the term of this patent is extended or adjusted under 35 U.S.C. 154(b) by 0 days.

(21) Appl. No.: 15/320,230

(22) PCT Filed: Jun. 19, 2014

(86) PCT No.: PCT/SE2014/050765
§ 371 (c)(1),
(2) Date: Dec. 19, 2016

(87) PCT Pub. No.: WO2015/195018
PCT Pub. Date: Dec. 23, 2015

(65) Prior Publication Data
US 2017/0135535 A1 May 18, 2017

(51) Int. Cl.
*A47K 10/34* (2006.01)
*A47K 10/42* (2006.01)
*A47K 10/36* (2006.01)

(52) U.S. Cl.
CPC ..... *A47K 10/422* (2013.01); *A47K 10/34* (2013.01); *A47K 10/421* (2013.01); *A47K 2010/3681* (2013.01)

(58) Field of Classification Search
USPC ..... 206/494
See application file for complete search history.

(56) References Cited

U.S. PATENT DOCUMENTS 2,809,082 A 10/1957 Marcuse
3,028,047 A 4/1962 Tuft
(Continued)

FOREIGN PATENT DOCUMENTS

CN 104853661 A 8/2015
JP H1176097 A 3/1999
(Continued)

OTHER PUBLICATIONS

International Search Report (PCT/ISA/210) dated Mar. 12, 2015, by the Swedish Patent Office as the International Searching Authority for International Application No. PCT/SE2014/050765.
(Continued)

*Primary Examiner* — Timothy R Waggoner
*Assistant Examiner* — Ayodeji T Ojofeitimi
(74) *Attorney, Agent, or Firm* — Buchanan Ingersoll & Rooney P.C.

(57) ABSTRACT

A dispenser for dispensing a sheet of web material from a stack of folded web material, the dispenser including: a web material storage section arranged to hold and support the stack of folded web material; the web material storage section including an upper end portion from which the web material is arranged to be lead for dispensing thereof, a lower end portion, opposite to the upper end portion, the upper end portion and lower end portion being arranged in a fixed spatial relationship. The lower end portion of the web material storage section includes a loading opening and a supporting arrangement, arranged to be movable between a support position wherein the supporting arrangement extends at least partially over said loading opening enabling the support of the stack of folded web material, and an insert position.

34 Claims, 9 Drawing Sheets

(56) References Cited

U.S. PATENT DOCUMENTS

| | | | | |
|---|---|---|---|---|
| 3,840,146 | A | 10/1974 | Bodek | |
| 5,642,836 | A | 7/1997 | Merriweather, Jr. | |
| 5,884,804 | A | 3/1999 | King | |
| 6,267,323 | B1 * | 7/2001 | Phelps | A47K 10/3827 242/588.3 |
| 8,146,775 | B2 * | 4/2012 | De Jong | A47K 10/28 221/11 |
| 2003/0080137 | A1 * | 5/2003 | Clark | A47K 10/425 221/34 |
| 2003/0201274 | A1 * | 10/2003 | Taylor | A47K 10/424 221/61 |
| 2010/0243504 | A1 | 9/2010 | Long et al. | |
| 2011/0101020 | A1 | 5/2011 | Granger | |
| 2011/0210137 | A1 * | 9/2011 | Kling | A47K 10/36 221/6 |
| 2014/0282680 | A1 | 9/2014 | Brandstetter | |
| 2015/0313425 | A1 | 11/2015 | Thoren et al. | |
| 2016/0022097 | A1 * | 1/2016 | Bengtsson | B65D 75/5827 206/494 |

FOREIGN PATENT DOCUMENTS

| | | | |
|---|---|---|---|
| RU | 2179819 | C2 | 2/2002 |
| RU | 140089 | U1 | 4/2014 |
| WO | WO 2014/065733 | A1 | 5/2014 |
| WO | WO 2014/098670 | A1 | 6/2014 |
| WO | WO 2014/098671 | A1 | 6/2014 |

OTHER PUBLICATIONS

Written Opinion (PCT/ISA/237) dated Mar. 9, 2015, by the Swedish Patent Office as the International Searching Authority for International Application No. PCT/SE2014/050765.

Office Action (Examination report No. 1 for standard patent application) dated Nov. 9, 2017, by the Australian Government—IP Australia in Australian Patent Application No. 2014398269, (3 pages).

The extended European Search Report dated Feb. 9, 2018, by the European Patent Office in corresponding European Application No. 14895312.8. (8 pages).

Office Action (Decision to Grant) dated Apr. 6, 2018, by the Federal Service for Intellectual Property, in Russian Patent Application No. 2017101526/12(002569) and an English Translation of the Office Action, (23 pages).

Office Action dated May 31, 2018, by the Gobierno De Colombia in corresponding International Patent Application No. PCT/SE2014/050765, and partial translation. (26 pages).

Office Action (Notification of the First Office Action (National Phase of PCT Application)) dated Aug. 1, 2018, by the State Intellectual Property Office (SIPO) of the People's Republic of China in corresponding Chinese Patent Application No. 201480079942.1, and an English Translation of the Office Action. (27 pages).

Office Action No. 10514 dated Sep. 21, 2018, by the Colombian Patent Office in Colombian Patent Application No. NC2016/0005664 and Agents Letter, (26 pages).

* cited by examiner

DISPENSER AND METHOD OF REPLENISHING A DISPENSER

TECHNICAL FIELD

The present invention relates to a dispenser and a method of replenishing a dispenser with web material.

BACKGROUND

A sheet material for e.g. wiping purposes may be provided in the form of a stack. Different kinds of dispensers for holding such a stack of sheet material, and for dispensing separate sheets of sheet material from such a stack, are known. Generally, there may be distinguished between two kinds of dispensers for stacks of sheet material; a first kind of dispenser from which sheet material is dispensed from a bottom end of the stack, and second kind of dispenser from which sheet material is dispensed from a top end of the stack. The first kind of dispenser is easily replenished with sheet material by placing fresh sheet material on top of sheet material remaining in the dispenser. This kind of dispenser has the drawback that the weight of large stacks of sheet material tends to make the dispensing of sheet material from the bottom end difficult. In the second kind of dispenser, irrespective of the weight of the stack, sheet material is easily dispensed from the top end. On the other hand, replenishing a dispenser of the second kind may pose a problem because the stack often has to be replenished from the bottom end.

The stack may be biased towards a dispensing opening and napkins may be dispensed from a top of the stack from the dispensing opening. Replenishing the latter type of dispensers may pose its own particular problems.

U.S. Pat. No. 2,809,082, with reference to its FIG. 6, discloses a dispenser wherein paper is fed from a top of a stack. The stack is replenished from its bottom. How replenishing is to be performed in practice is not discussed.

US 2011/0101020 discloses a dispenser comprising a housing with a back plate and a cover. A base of the cover is articulated on a connecting pin. A support-container holds a stack of pre-cut material which is in use and can hold a spare stack. A base of the support-container is articulated around the same axis of rotation and the cover internally has a horizontal plate which supports the stack in use after swiveling the cover and support-container to load the spare stack. The support-container fits inside and is dismountably attached to the housing after swiveling into the internal space of the housing, which causes downward displacement of the stack in use, allowing the spare stack to be inserted into the internal space. That is, the support-container is turned upside down to access a bottom of the stack in use for replenishing the dispenser with the spare stack. The stack in use and the spare stack are joined to each other after positioning the spare stack on the other stack.

In dispensers for folded web material, intended to comprise several initially separate stacks of web material which are joined to form a continuous folded web material for dispensing, the refill procedure will comprise a step of joining the initially separate stacks of web material together. There is a general need for providing a simple and reliable refill procedure, enabling joining of separate stacks.

In dispensers for folded web material, an attendant performing the refill procedure might attempt to store a too large amount of folded web material into the dispenser. This might cause problems, since the folded web material present in the stack will then strive to expand inside the dispenser, which risks causing problems with the material becoming pinched, and difficult to dispense.

There exists a need for an alternative arrangement for replenishing a dispenser with a stack of folded web material from a bottom end of a dispenser. There exists a need for an arrangement which enables simplified loading also when the several independent stacks of web material are to be joined. There exists a need for an arrangement which diminishes the risk of a user filling it with excessive amounts of web material.

SUMMARY

An object of the present invention is to provide a dispenser which fulfills one or more of the above-mentioned needs. In particular, an object of the present invention is to provide a dispenser which is arranged for replenishing of the dispenser with folded web material from a bottom end of the folded web material In a first aspect, the object is achieved by a dispenser for dispensing a sheet of web material from a stack of folded web material, the dispenser comprising: a web material storage section arranged to hold and support the stack of folded web material, in a generally vertical direction during dispensing of the web material; the web material storage section comprising an upper end portion from which the web material is arranged to be lead for dispensing thereof, a lower end portion, opposite to the upper end portion and being arranged to support the stack of folded web material in said generally vertical direction, at least when the dispenser is in said dispensing position, said upper end portion and lower end portion being arranged in a fixed spatial relationship.

The lower end portion of the web material storage section comprises a loading opening and a supporting arrangement, arranged to be movable between a support position wherein the supporting arrangement extends at least partially over said loading opening enabling said support of the stack of folded web material, and an insert position, wherein the supporting arrangement is at least partially removed from the loading opening;

wherein said supporting arrangement is arranged to be movable from said support position to said insert position by pushing a stack to be introduced in the loading opening towards the supporting arrangement in a direction towards the upper end portion of the web material storage section.

The supporting arrangement is arranged in the loading opening so as to, if a new stack of web material is pushed towards the supporting arrangement in a direction towards the upper end portion of the support material, the supporting arrangement is moved away from the loading opening, enabling introduction of the stack into the loading opening.

Any web material already present in the web material storage section may be pushed further towards the upper end portion of the storage section upon introduction of the new stack of web material.

At least in a dispensing position, the web material storage section will assume a generally upright vertical position. In this position, the web material comprised in the storage section will be supported in a generally vertical direction by the supporting arrangement, and the force of gravity will act so as to compress the web material to a pile resting on said support arrangement.

Stacks of web material may be prepared for replenishment of the dispenser, which stacks comprises connector members for interconnecting several stacks to a continuous web material inside the web material storage section. Connector members may be designed so as to be automatically interconnectable upon compression of the web material to a pile when the web material is resting on the support arrangement. Accordingly, interconnection of stacks of web material during the refilling of the dispenser may be facilitated.

The supporting arrangement may comprise at least one, preferably two projection members.

The projection member may be retractable from the support position to said insert position. Such a retractable projection member may for example be achieved by the projection member being movable in a direction extending over said loading opening. For example, the projection member may be arranged so as to be extendible and retractable via an aperture provided in a circumferential wall forming the loading opening. The projection member may be retractable in a direction substantially perpendicular to a longitudinal direction extending along the web material storage section, from the lower end portion to the upper end portion. The projection member may be retractable in a direction substantially parallel to a support surface formed by the supporting arrangement when in the support position.

The supporting arrangement may be arranged to enable said support position to be reassumed, when said stack is pushed a distance (D), along a direction towards the upper portion, from the support position of the supporting arrangement. Advantages obtained by this feature will be described in the below in relation to another variant of a dispenser. It will be understood that the effect of this feature, and its combined effect with other features as described in the below are similar when applied to the above-mentioned variant of a dispenser.

In a second aspect, this object is achieved by a dispenser for dispensing a sheet of web material from a stack of folded web material, the dispenser comprising:

a web material storage section arranged to hold and support the stack of folded web material, in a generally vertical direction during dispensing of the web material; the web material storage section comprising an upper end portion from which the web material is arranged to be lead for dispensing thereof, and and a lower end portion, opposite to the upper end portion and being arranged to support the stack of folded web material in said generally vertical direction, at least when the dispenser is in said dispensing position.

The lower end portion of the web material storage section comprises a loading opening and a supporting arrangement, arranged to be movable between a support position wherein the supporting arrangement extends at least partially over said loading opening enabling said support of the stack of folded web material, and an insert position, wherein the supporting arrangement is at least partially removed from the loading opening; wherein said supporting arrangement is arranged to be movable from said support position to said insert position by pushing a stack to be introduced in the loading opening towards the supporting arrangement in a direction towards the upper end portion of the web material storage section, wherein said supporting arrangement is arranged to enable said support position to be reassumed, when said stack is pushed a distance (D), along a direction towards the upper portion, from the support position of the supporting arrangement.

Accordingly, there is provided a dispenser having a web material storage section for storing folded web material during dispensing thereof. The web material storage section has a loading opening arranged in a lower end portion thereof, where a supporting arrangement is arranged to provide a vertical support for the folded web material. The supporting arrangement is arranged in the loading opening so as to, if a new stack of web material is pushed towards the supporting arrangement in a direction towards the upper end portion of the support material, the supporting arrangement is moved away from the loading opening, enabling introduction of the stack into the loading opening. Further, the supporting arrangement is arranged so as to, upon continued pushing of the stack a distance D past the support position of the supporting arrangement, reassume its support position.

During a refill procedure, an attendant may fill the web material storage section with folded web material via said loading opening. As explained in the above, for introduction of new web material in the dispenser, the new material must be pushed at least the distance D past the support position of the supporting arrangement. Accordingly, once the new web material is pushed past the distance D, the supporting arrangement will resume the support position. The return to the support position enables the web material present in the web material storage section to move the distance D towards the support arrangement. This movement may, at least when the loading opening is directed partly downwards, occur as soon as the supporting arrangement reassumes the support position. However, the movement may also occur in a later stage, e.g. when the dispenser is brought from a loading position to a dispensing position, in which the support arrangement is active to support the web material. Anyhow, the distance D becomes available for storage of web material when the supporting arrangement is in the support position, but is not available for storage of web material when the supporting arrangement is in the insert position.

The fact that the distance D must be traveled by newly introduced web material for correct function of the supporting arrangement ensures that the dispenser will not be filled with an excessive amount of folded web material.

The upper end portion and lower end portion may be arranged in a fixed spatial relationship. In this case, the web storage section will have a fixed relative extension and orientation between said upper and lower end portion. The web storage section per se might be moved, e.g. between a dispensing position and a loading position, as will be described in the below.

In other variants the upper end portion and the lower end portion may be arranged so as to allow variation of their spatial relationship. For example, the spatial relationship between the upper and the lower end portions may vary between a dispensing position, and a loading position of the dispenser.

In such variants, the web material storage section may comprise a displaceable portion, the displaceable portion preferably comprising the lower end portion, wherein the lower end portion, seen along the vertical direction, is arranged substantially underneath the upper end portion when the displaceable portion is arranged in a dispensing position, and the displaceable portion is displaceable from the dispensing position to a tilted loading position, in which tilted loading position the lower end portion is positioned beside and below the upper end portion, seen along the vertical direction.

In this variant, the dispenser may assume a loading position in which the loading opening is readily available.

This alternative is particularly useful for relatively large dispensers, having a storage section extending over a great vertical distance in the dispensing position. Such a storage section would, if the complete storage section were tilted to assume a loading position, take up a large amount of space. By tilting only a displaceable portion of the storage section, easy loading may be provided in a space-saving manner.

The displaceable portion may be upwardly pivotable in relation to the vertical direction.

The displaceable portion in the tilted loading position may be pivoted to an angle of between 30-100 degrees, preferably approximately 90 degrees, from a downward direction along the vertical direction.

The web material storage section may comprise a fixed portion above the displaceable portion, seen along the vertical direction, and wherein the displaceable portion comprises a transitional portion forming a gradual transition from the displaceable portion to the fixed portion when the displaceable portion is positioned in the tilted loading position.

At least in the dispensing position, the dispensing opening may be arranged above the lower end portion, seen along the vertical direction.

In the below, features useful in combination with either one out of the above-mentioned aspects of the invention will be described.

The dispenser may be a standalone unit or may be mounted to a structure such as a wall, a piece of furniture, or a door. The dispenser may be arranged for manual dispensing of web material through the dispensing opening by a user pulling on a tail of the web material. The dispenser may alternatively be arranged for automatic dispensing of web material through the dispensing opening. The automatic dispensing may comprise electrically powered feeding of web material or a mechanical feeding of web material. In both cases a user may actuate the feeding.

The web material may be provided as a continuous web material which is folded to form a folded web material. Similarly, a stack of folded web material for replenishing the folded web material in a dispenser may comprises a continuous web material. Herein, the term "replenishing" or "loading" not only relates to the replenishing or loading of a dispenser which is partially filled with a stack of folded web material, but is understood to also encompass loading of an empty dispenser. The continuous web material may be separated during dispensing. Dispensed sheets of web material from the dispenser may be used as towels, napkins, for general wiping, etc. The folded web material may be Z-folded in an accordion-like manner to form the stack of folded web material.

The web material may comprise one or more web layers. In the case of more than one web layer, the layers are interfolded in the stack. One or more sheets of web material may be separated from the web material in the dispenser during dispensing from the dispenser. For this purpose the web material may be provided with lines of weakness, perforations. Alternatively, the web material may be non-perforated, in which case the dispenser may be provided with a cutting arrangement or tearing arrangement for separating a sheet from the tail of web material. One or more packages of folded web material are arranged to be placed in the web material storage section of the dispenser to form a stack of folded web material.

The tail of the web material may be arranged to extend from the upper end portion of the web material storage section to a dispensing opening of the dispenser. The tail of the web material may change direction one or more times inside the dispenser between the upper end portion of the web material storage section and the dispensing opening.

As explained in the above, with "continuous web material" is meant a material which may be continuously fed for example when arranged in an appropriate dispenser. Preferred web materials are in particular such that are suitable for forming absorbent tissues for personal use, e.g. for wiping the hands of a user after wash, for napkins, or for object wiping purposes.

The term "web material" is herein to be understood to include tissue paper materials, nonwoven materials, and materials being a mixture of tissue paper and nonwoven materials.

The term "tissue paper" is herein to be understood as a soft absorbent paper having a basis weight below 65 g/m$^2$, and typically between 10 and 50 g/m$^2$. Its density is typically below 0.60 g/cm$^3$, preferably below 0.30 g/cm$^3$, and more preferably between 0.08 and 0.20 g/cm$^3$. The tissue paper may be creped or non-creped. The creping may take place in wet or dry condition. The tissue paper may be made by TAD or atmos-methods. The fibres contained in the tissue paper are mainly pulp fibres from chemical pulp, mechanical pulp, thermo mechanical pulp, chemo mechanical pulp and/or chemo thermo mechanical pulp (CTMP). The tissue paper may also contain other types of fibres enhancing e.g. strength, absorption or softness of the paper. These fibres may be made from regenerated cellulose or synthetic material such as polyolefins, polyesters, polyamides etc.

The term "nonwoven" is applied to a wide range of products which in term of their properties are located between the groups of paper and cardboard on the one hand and textiles on the other hand. As regards nonwovens a large number of extremely varied production processes are used, such as airlaid, wetlaid, spunlaced, spunbond, meltblown techniques etc. The fibres may be in the form of endless fibres or fibres prefabricated with an endless length, as synthetic fibres produced in situ or in the form of staple fibres. Alternatively, they may be made from natural fibres or from blends of synthetic fibres and natural fibres.

The web material may be recycled flexible material, newly-produced material or a combination thereof. Similar stacks as the one described in FIG. 1 may be provided comprising one single continuous web material, or several interfolded continuous web materials.

Where said supporting arrangement is arranged to enable said support position to be reassumed, when said stack is pushed a distance (D), along a direction towards the upper portion, from the support position of the supporting arrangement, the support arrangement may be arranged so as to traverse said distance (D) inside the storage section when moving between said support position and said insert position.

Hence, the supporting arrangement will perform a movement inside the storage section, which movement requires the space extending along distance D inside the container to be free.

The supporting arrangement may be arranged to automatically reassume the support position when said stack is pushed said distance D along said direction. Automatic reassuming of the supporting arrangement to the support position will enable e.g. a first stack to be loaded and then released in the web storage section, without risk that the stack falls out of the loading opening.

To automatically reassume the support position, the supporting arrangement may be biased towards the support position.

The supporting arrangement may be arranged to provide a distance D being at least 20 mm, preferably at least 40 mm. These distances may in many cases provide a suitable free space inside a fully loaded web storage section, to ensure that no problems with overfill of web material will occur.

The supporting arrangement may comprise at least one, preferably two projection members. Said projection members may advantageously project from two opposite sides of said loading opening.

The projection member may be pivotable between said support position and said insert position. To this end, the projection member may be pivotable in a direction towards the upper end portion for moving between the support position and the insert position.

The projection member may be pivotable about a pivot axis located at the side of the loading opening, enabling the projection member to perform a pivoting movement inside the loading opening, hence traversing a distance D during the pivoting to a release position. The distance D may be substantially equal to an extension of the projection member.

The upper portion of the web material storage section may comprise an upper stop member, arranged to delimit the space available for folded web material in the web material storage section in a direction towards the upper end portion.

To this end, the upper stop member may e.g. be arranged to extend over the web material storage section, such that an upper end of a pile of web material contained therein may abut the upper stop member.

The upper stop member may be formed as a part of the web material storage section, it may be formed as a structure integral with a web material storage section (in some variants a housing). The upper stop member may be a part serving only the function to delimit the space available for folded web material, or it may be a part useful to perform additional functions besides forming an upper stop member.

An upper stop member being arranged to delimit the space available for folded web material in the web material storage section may further enhance the overfill protection of a dispenser. For fully loading a dispenser comprising a support arrangement, where the introduction of new web material necessitates that the web material is brought a distance D from the support position, web material may be loaded into the dispenser during one or several loading operations. Eventually, when the web material storage section is close to filled with web material, an upper end of the pile of web material contained in the web material section will reach the upper stop member provided in the upper end of the storage section. Accordingly, the total space available for web material in the web storage section, during the introduction of new web material, extend between the upper stop member in the upper end portion, and a location said distance D past the support position of the supporting arrangement (towards the upper end portion). When said total space is completely filled with web material, the supporting arrangement will resume the support position, resulting in that the total space available for web material is expanded by the volume corresponding to said distance D. Accordingly, the total space available for the web material in the web material storage section when the web material is vertically supported, such as when the dispenser is in a dispensing position, is larger than the total space available during loading.

In certain variants, when the dispenser is in said dispensing position, said loading opening and said supporting arrangement are accessible for loading of stacks into the storage section. When the dispenser is in the dispensing position, the material storage section will extend in a generally vertical direction. Hence, the loading opening will be open in a generally downward direction, and web material may be introduced therein by upward pushing of the web material past the support position of the supporting arrangement. In this case, the supporting arrangement may be arranged to automatically reassume its supporting position by the mere action of gravity on the supporting arrangement.

In other variants, the dispenser may movable from said dispensing position to a loading position, wherein said loading opening and supporting arrangement are accessible for loading of stacks into the storage section. In this case, the loading opening may be moved to a position being more easily accessible to a user than a vertically downwardly directed position.

For example, the web material storage section may be tiltable from said dispensing position to said loading position.

In some variants, in said loading position, the storage section is arranged with said upper end portion at a location vertically above said lower end portion In some variants, in said loading position, said storage section may form an angle of less than about 90 degrees with said vertical direction, preferably less than 80 degrees. Hence, any web material contained in the storage section will still be affected by gravity so as to be pushed towards the lower end of the storage section, or the upper end of the storage section, depending on the orientation of the web material storage section. This may be advantageous for accomplishing interconnection of the connectors of the stacks already during the loading procedure.

When, in said loading position, the storage section is arranged with the upper end portion at a location vertically above the lower end portion, and the storage section forms an angle of less than about 90 degrees with the vertical direction, web material initially present in the storage section will, by action of gravity, be present at the lower end portion of the storage section during loading of new web material. Hence, interconnection between initial web material and a stack of new web material may be accomplished or ensured by an attendant.

The supporting arrangement may be the only arrangement in said web material storage section which provides support to a stack in said generally vertical direction, when the dispenser is in said dispensing position. Hence, it may be ensured that the web material contained in the stack is freely movable between the lower end portion and the upper end portion, so as to obtain the desired effects associated therewith.

The supporting arrangement may be the only arrangement in said web material storage section which provides support to a stack in a direction towards the upper end portion of the storage section, when the dispenser is in said loading position. Hence, it may be ensured that the web material contained in the stack is freely movable between the lower end portion and the upper end portion, so as to obtain the desired effects associated therewith.

The loading opening may be formed at in the lower end of the web material storage section, with a portion of said lower end portion extending below said opening, so as to form a surface towards which the stack may abut before introduction into the loading opening.

However, the loading opening may also formed by a lowermost end of the web material storage section, such that the lower end portion ends with said loading opening. This may be desired to save space in the dispenser arrangement.

Similarly, the supporting arrangement may be arranged at a lowermost end of the web material storage section.

The dispenser may comprise a housing, and said web material storage section may be positioned inside the housing. The dispenser may comprise a dispensing arrangement including a dispensing opening for the web material in the housing.

In another aspect, there is provided a method of replenishing a dispenser in accordance with the above, wherein the method comprises:

- placing an end surface of a stack of folded web material to abut against the supporting arrangement,
- pushing said stack of folded web material towards the upper end of the web storage section, so as to move the supporting arrangement from its support position to its release position;
- releasing said stack when positioned beyond the supporting arrangement, allowing the return of the supporting arrangement to its support position.

In another aspect, there is provided a method of replenishing a dispenser in accordance with the above, wherein the method comprises:

- placing an end surface of a stack of folded web material to abut against the supporting arrangement,
- pushing said stack of folded web material towards the upper end of the web storage section, so as to move the supporting arrangement from its support position to its insert position;
- continuing pushing of said stack towards the upper end to a position a distance D from the support position, so as to enable the supporting arrangement to reassume the support position;
- releasing said stack inside the web storage section, allowing the return of the supporting arrangement to its support position.

The dispenser may comprise an initial stack of web material, said initial stack and said stack comprising corresponding connector means, and said introduction of the stack adjacent the initial stack in the web storage section resulting in interconnection of the stacks via said connector means.

Suitable connector means could be any means being interconnectable by corresponding connectors meeting, possibly requiring a light pressure to be applied, such as adhesive connectors or mechanical connectors. Mechanical connectors such as hook and loop connectors are preferred.

Further features of, and advantages with, the present invention will become apparent when studying the appended claims and the following detailed description. Those skilled in the art will realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this disclosure should not be construed as limited to the embodiments set forth herein. Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Figure 1A:
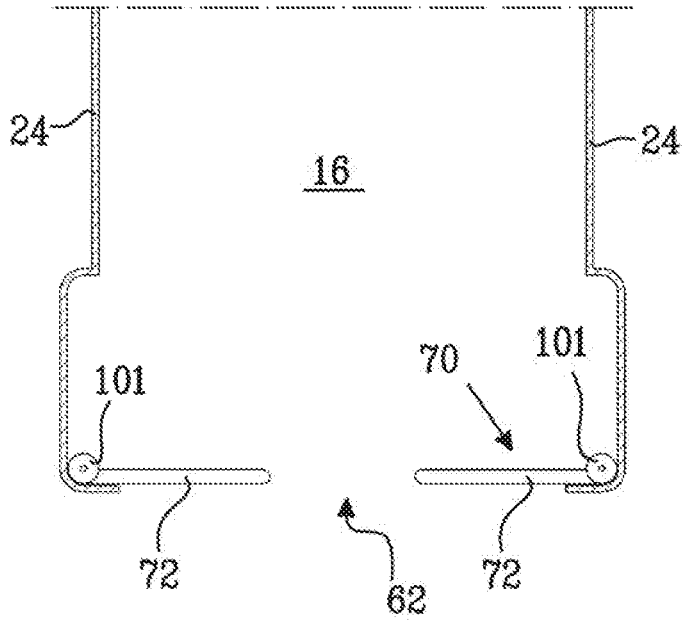
FIGS. 1*a* and 1*b* illustrate schematically a lower end portion of a web storage section of an example of a dispenser.
Figure 1B:
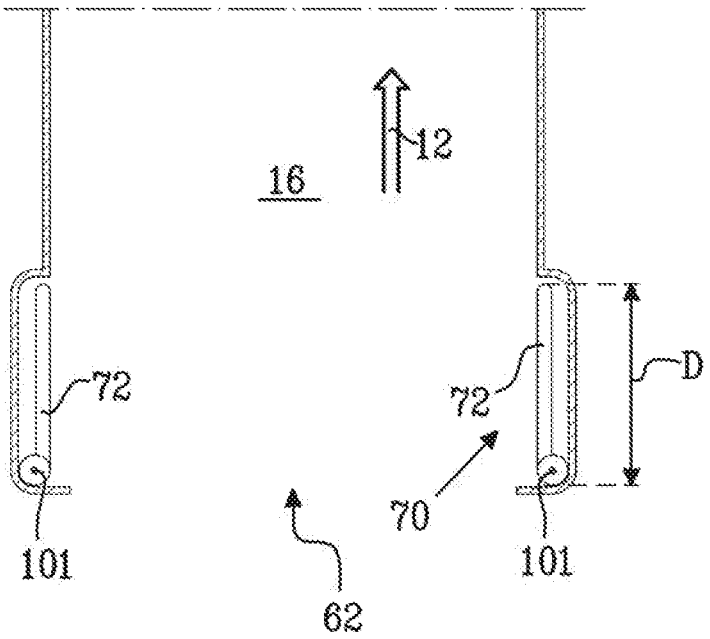

FIGS. 1*a* and 1*b* illustrate schematically the lower end portion 20 of a web storage section 16 of a dispenser. In a dispensing position, the web storage section 16 is to be arranged in along a vertical direction 12, with the lower end portion 20 directed downwardly, and an opposing upper end portion 18 (not shown) directed upwardly along said vertical direction.

The web storage section 16 defines a loading opening 62, through which web material may be inserted in a direction towards the upper end portion 18. A supporting arrangement 70 is arranged at the lower end portion 20.

In FIG. 1*a*, the supporting arrangement 70 is illustrated in a support position, in which the supporting arrangement 70 extends partially over the loading opening 62, so as to enable support of the web material contained in the web storage section 16, at least when the web storage section 16 is in a dispensing position.

In FIG. 1*b*, the supporting arrangement 70 is illustrated in an insert position, in which the supporting arrangement is moved away from the loading opening 62, so as to enable web material to be introduced via the loading opening 62 in a direction towards the upper end portion 18.

In FIGS. 1*a* and 1*b*, the supporting arrangement 70 comprises two opposing support members 72. The support members are pivotable between the support position and the insert position. When pivoting from the support position to the insert position, the support members 72 will traverse a distance D towards the upper end portion 18.

In the illustrated variant, each support member 72 is pivotable about a respective pivot axis 101, the two pivot axes 101 being arranged on opposing sides of the web storage section 16, adjacent the loading opening 62.

The pivot axes 101 allow for pivoting of the support members 72 about 90 degrees towards the upper end portion 18.

Accordingly, the distance D traversed by the support members 72 corresponds to the extension of each support member over the loading opening 62, when in the support position.

The supporting arrangement 70 is arranged to be movable from said support position to said insert position by pushing a stack to be introduced in the loading opening towards the supporting arrangement 70 in a direction towards the upper end portion 18 of the web material storage section 16. Moreover, the supporting arrangement 70 is arranged to enable said support position to be reassumed, when said stack 82 is pushed the distance (D), along the direction towards the upper portion 18, from the support position of the supporting arrangement 70.

If the web material section 16 is oriented with its lower end portion 20 below the upper end portion 18 when the dispenser is in a loading position, the supporting arrangement 70 may reassume its support position merely by gravity acting on the supporting arrangement (i.e. the support members 72).

Alternatively, the support arrangement 70 may be biased towards the support position, such that the support arrangement 70 will strive to the support position as soon as it is released from the insert position.

When the support arrangement 70 is biased towards the support position, the material section 16 may assume any orientation when in the loading position of the dispenser, and still the support arrangement will strive towards the support position.

FIGS. 2*a* to 2*d* illustrate schematically the refill of a dispenser comprising a lower end section 20 e.g. as described in relation to FIGS. 1*a* and 1*b*.

Figure 2A:
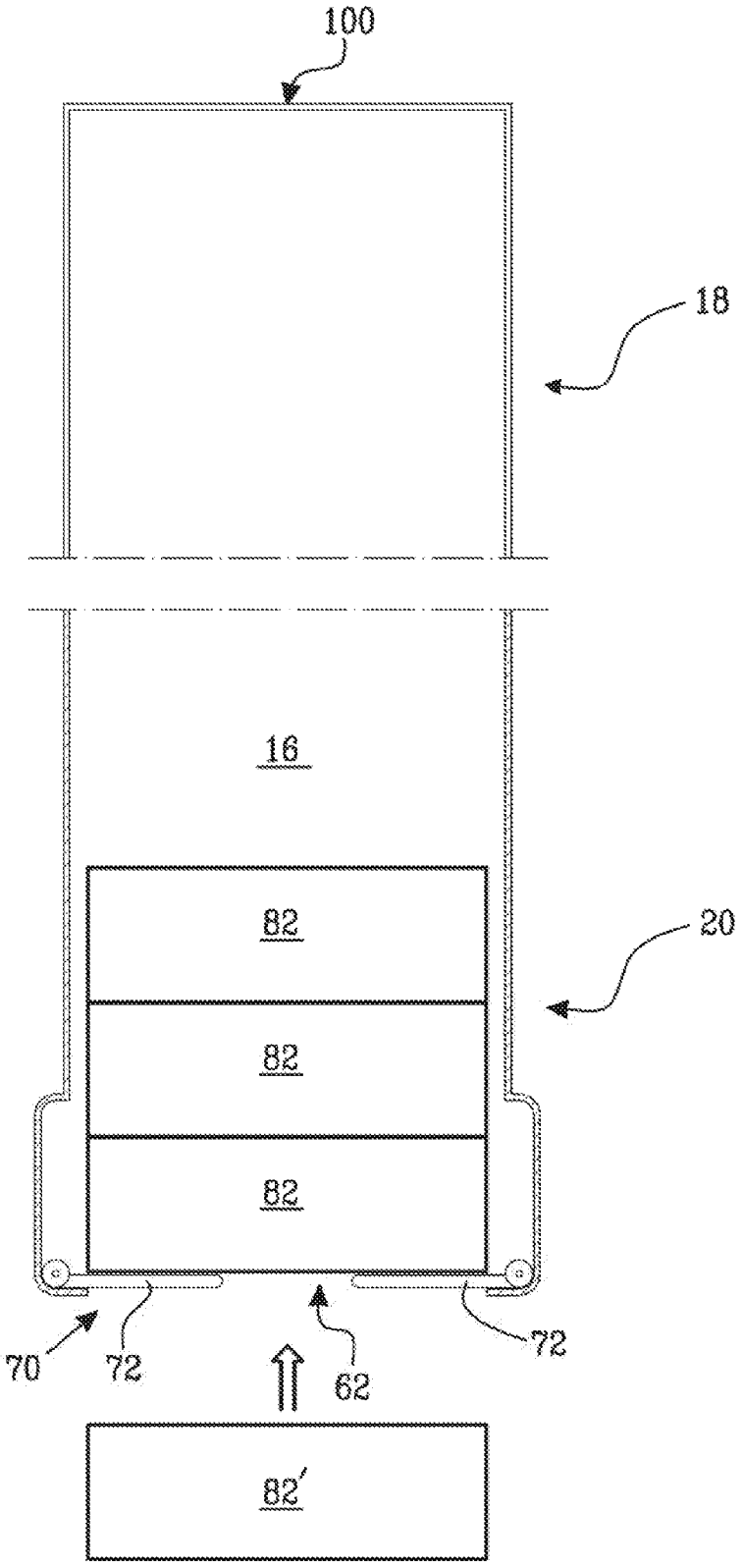
FIGS. 2*a* to 2*d* illustrate schematically a lower end portion of a web storage section of an example of a dispenser during loading of a stack of web material.

In FIG. 2*a*, the web material storage section comprises an amount of web material, illustrated herein as three separate stacks of web material 82. To form a continuous web material, the three separate stacks of web material 82 are preferably interconnected, e.g. via connector means provided at the ends of the stacks.

A new stack 82' is to be introduced into the web material storage section 16, and is pushed towards the supporting arrangement 70 in a direction towards the upper end 18 of the web material storage section 16.

Figure 2B:
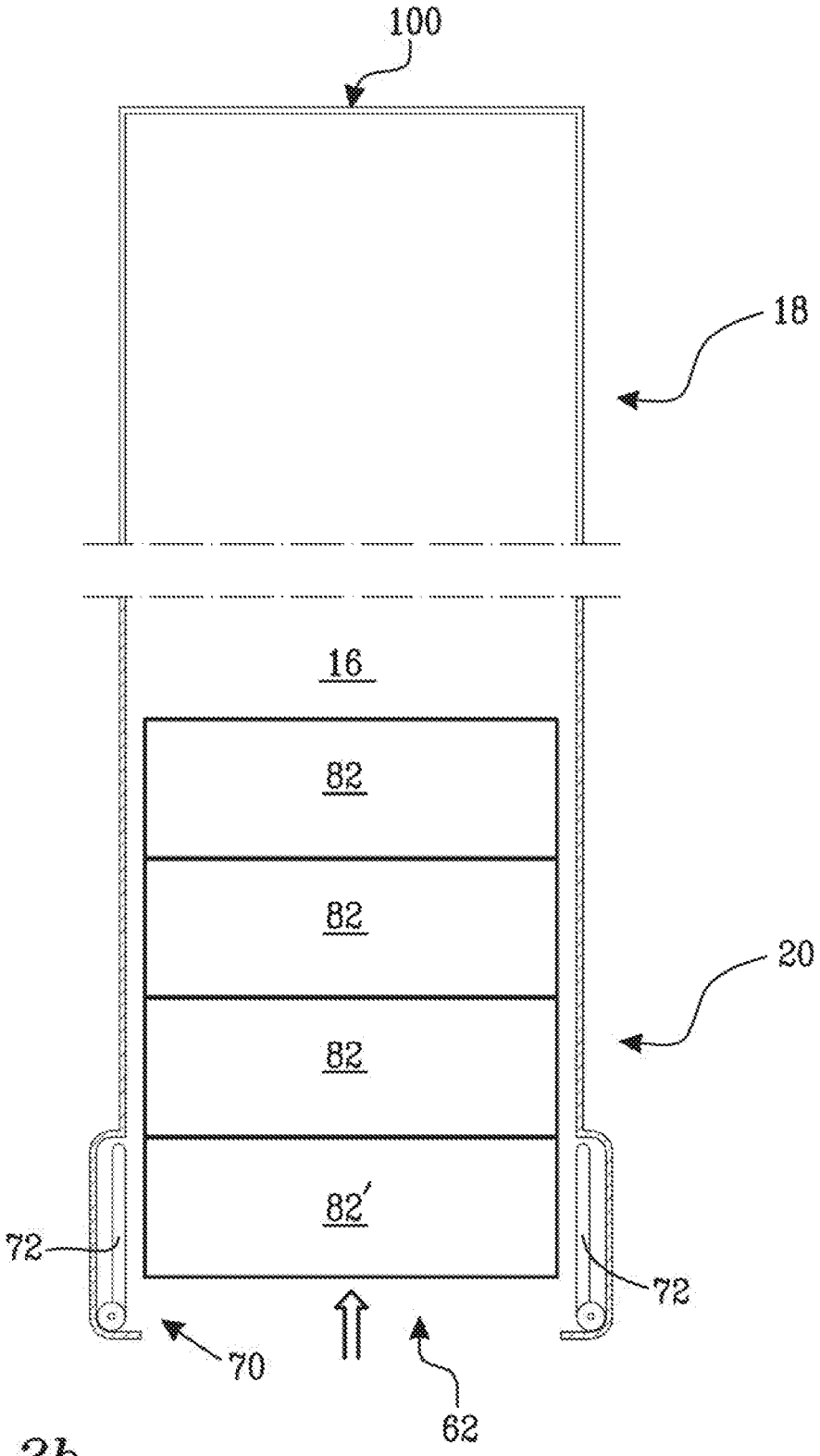

The stack will hence abut the supporting arrangement 70, and move the arrangement from the support position to the insert position, as illustrated in FIG. 2*b*. In FIG. 2*b*, the new stack 82' holds the supporting arrangement 70 in its loading position.

As illustrated, the web material 82 already contained in the web storage section 16 is also pushed towards the upper end 18 of the storage section by the new stack 82'. This will be the case at least when the web storage section 16 is arranged with the lower end 20 below the upper end 18, when in a loading position of the dispenser.

Figure 2C:
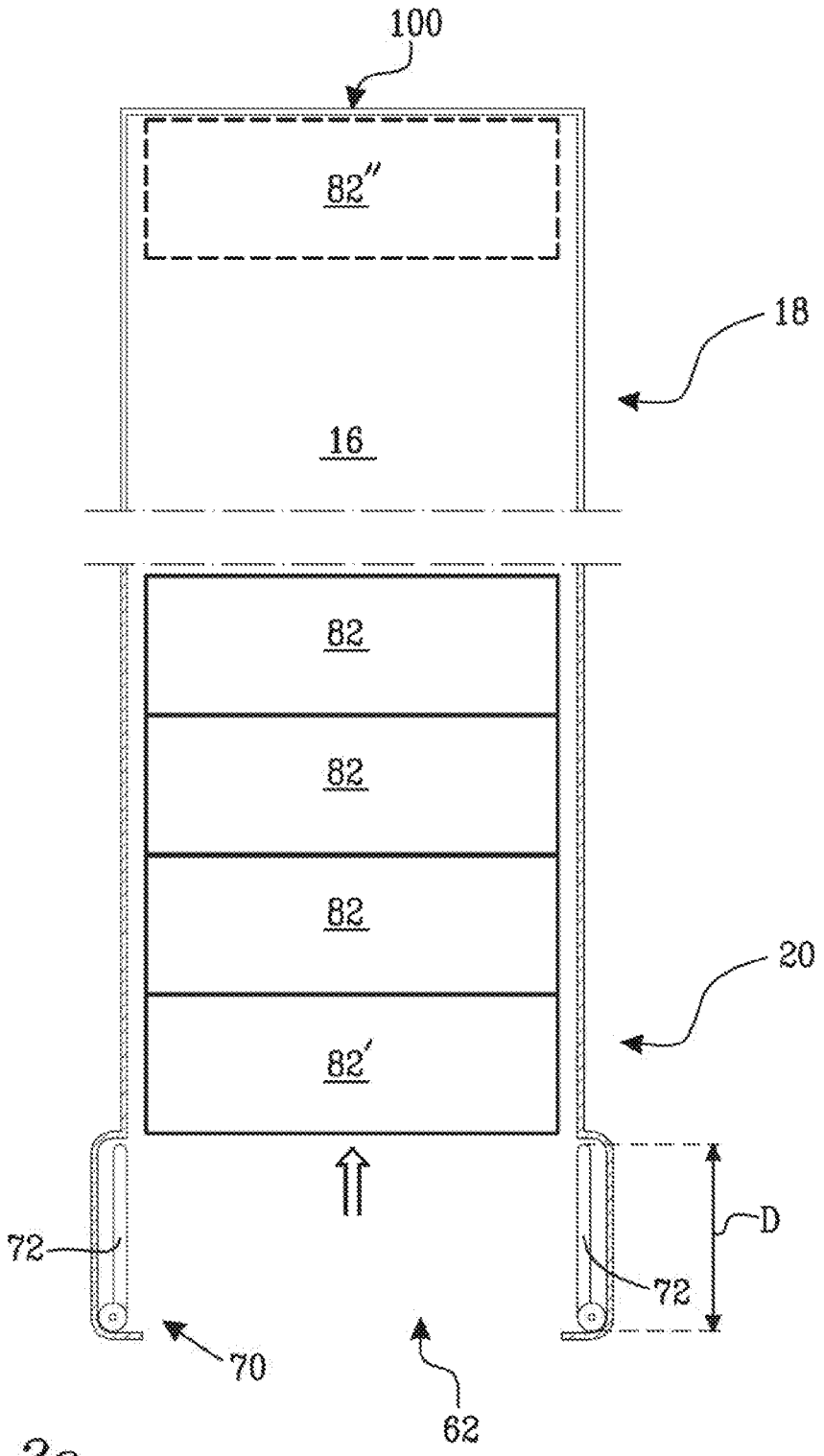
Figure 2D:
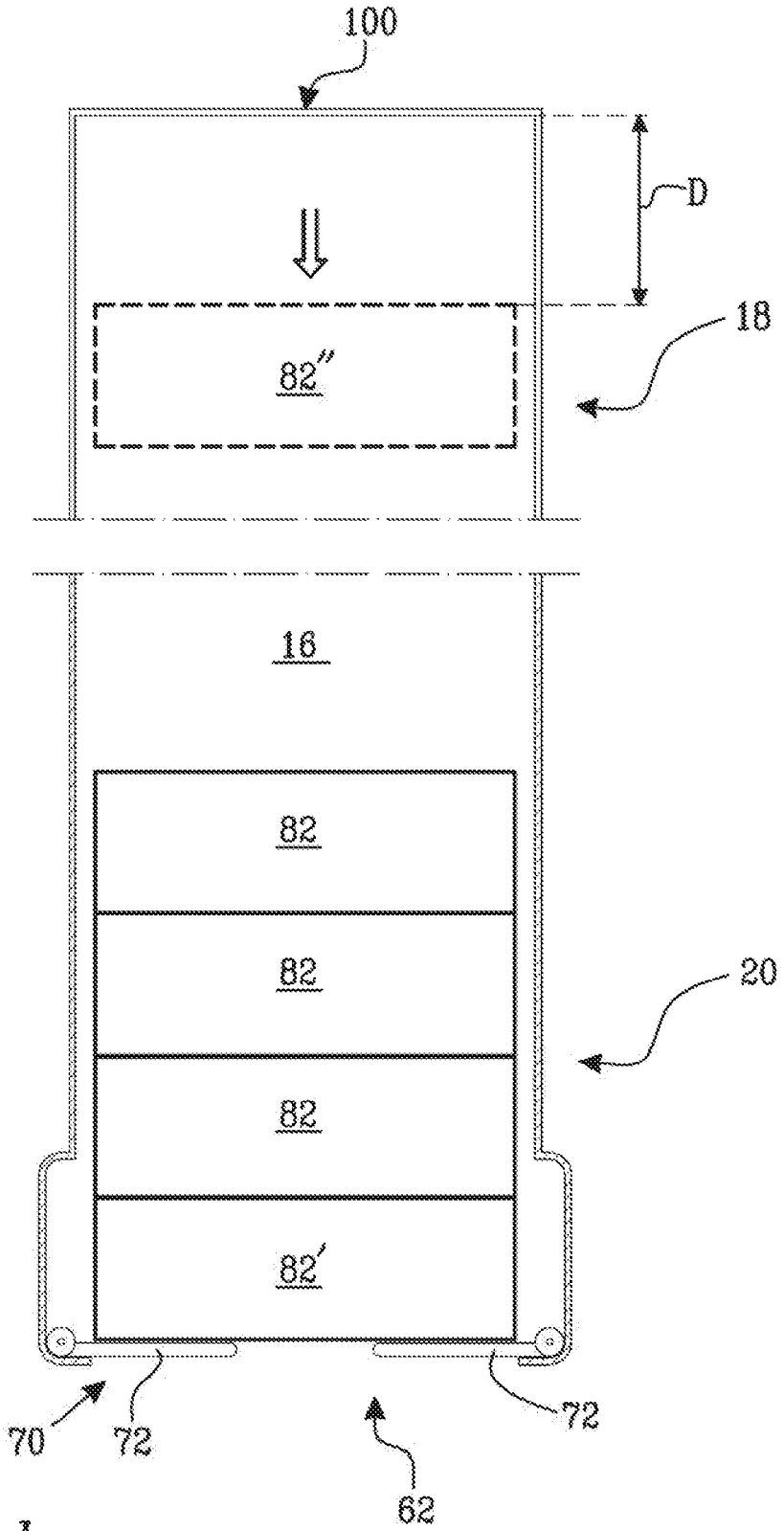

In FIG. 2*c*, a situation is illustrated where the new stack 82' is moved just past the support members 72 of the support arrangement. Hence, the new stack 82' has just traveled a distance from the support position corresponding to the distance D traversed by the support arrangement 70 when moving from the support position to the release position. Accordingly, the support arrangement 70 will be able to reassume the support position, as illustrated in FIG. 2*d*. In FIG. 2*d*, the new stack 82' is in place inside the web storage section 16, and supported by the support arrangement.

In the variant schematically illustrated in FIGS. 2*a*-2*d*, the upper end portion 18 of the web storage section 16 also comprises an upper stop member 100. The upper stop member 100 delimits the space of the storage section 16 available for the web shaped material.

As illustrated in FIGS. 2*c* and 2*d*, when the web storage section 16 is about to be completely filled with web material, a portion 82" of web material will abut the upper stop member 100, and web material will fill the web storage section 16 all the way from the upper stop member 100 towards the support arrangement 70. However, as illustrated in FIG. 2*c*, when the uppermost portion 82" of web material reaches the upper stop member 100, it will no longer be possible to move new web material past the distance D of the supporting arrangement.

Hence, in the insert position, the distance D of the lower end portion 20 traversed by the supporting arrangement is not available for introduction of web material. When the web material storage section above said distance D is completely filled with web material, the support arrangement 70 will reassume the support position as illustrated in FIG. 2*d*.

At least when the web material section 16 is in its generally vertical dispensing position, the web material contained in the dispenser will fall down so as to be supported by the supporting arrangement 70 which is in the support position. Accordingly, a space forming a distance D will be available between the uppermost web portion 82' and the upper stop member 100.

Accordingly, problems connected to filling the dispenser with an excessive amount of web material may be avoided.

Figure 3A:
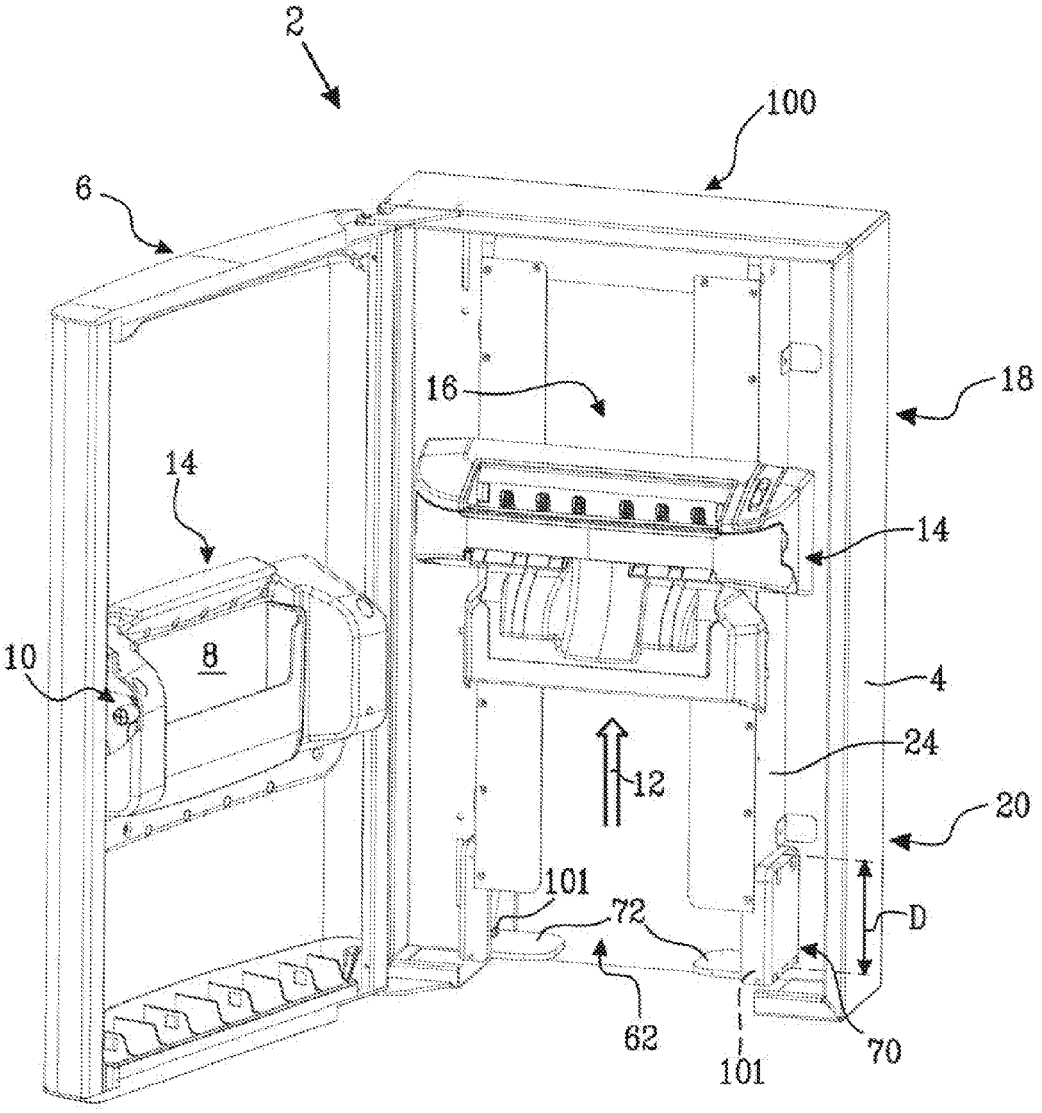
FIGS. 3*a* and 3*b* illustrate an embodiment of a dispenser with the support arrangement in a support position, and in an insert position, respectively.
Figure 3B:
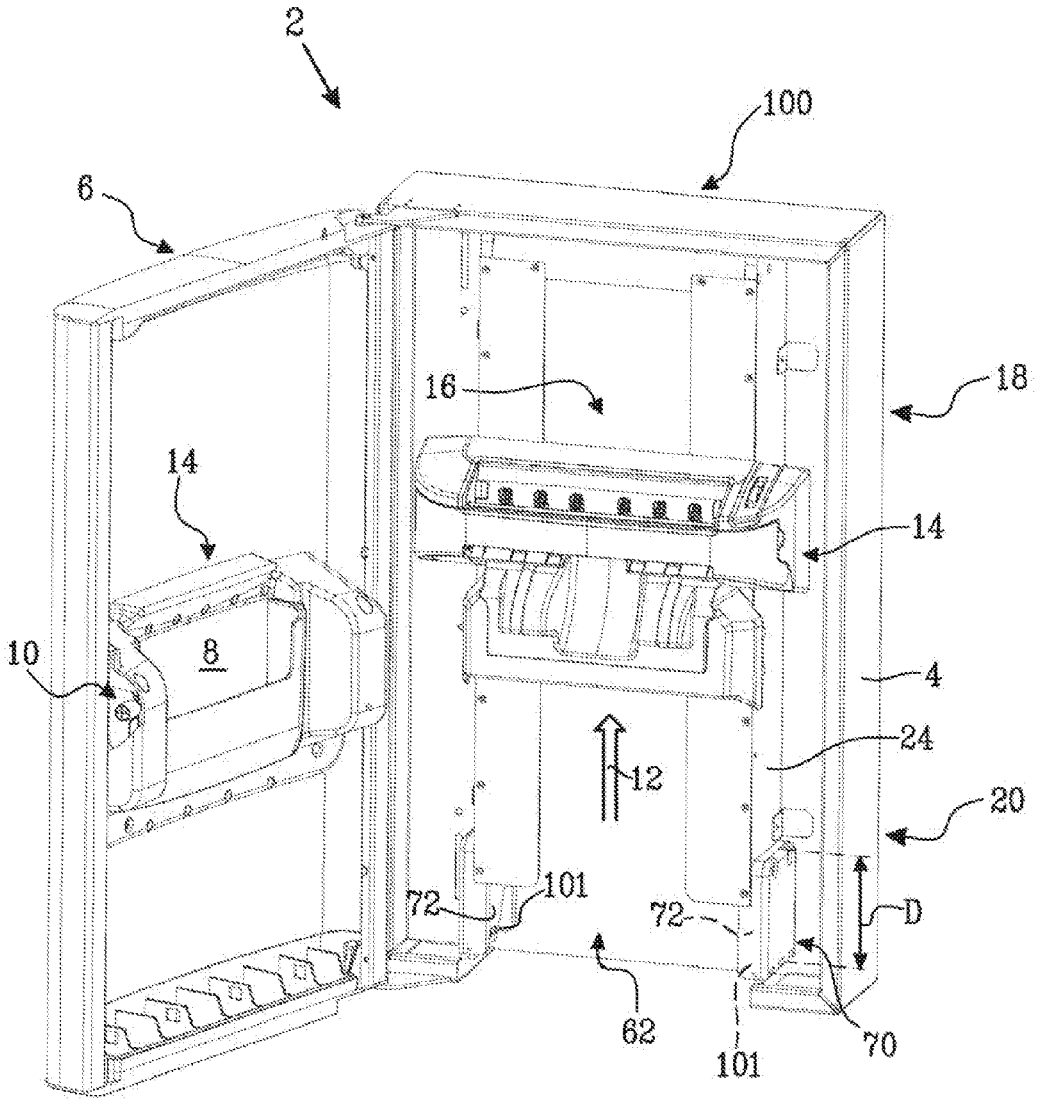

FIGS. 3*a* and 3*b* illustrates a dispenser 2 for dispensing at least one sheet of web material. The dispenser 2 comprises a housing 4. The housing 4 is arranged to be positioned along a vertical direction 12. Thus, the housing 4 has natural top and bottom ends when the dispenser 2 is installed at a site for dispensing sheets of web material therefrom. The housing 4 comprises a door 6. In the door 6, a dispensing opening 8 is provided for dispensing the sheet of web material. The door 6 is arranged to be opened and thus, to provide access to an interior of the dispenser 2, e.g. for the purpose of replenishing the dispenser 2 with stacks of folded web material.

However, other variants are conceivable, where the dispenser may be refillable without need for opening a door.

FIGS. 3*a* and 3*b* illustrate the dispenser with the door 6 in an open position. The door 6 may be locked in a closed position by means of a locking arrangement 10.

The dispenser 2 is arranged for dispensing web material from a folded web material which may be Z-folded in an accordion-like manner. The web material has been omitted in FIGS. 3*a* and 3*b* for clarity reasons. The dispenser 2 comprises a dispensing arrangement 14 including the dispensing opening 8.

A web material storage section 16 is provided inside the housing 4. The web material storage section 16 is arranged to hold and support the folded web material.

The web material storage section 16 comprises, seen along the vertical direction 12, an upper end portion 18 and an opposite lower end portion 20. The web material is arranged to be lead to the dispensing arrangement 14 from the upper end portion 18 and the stack of folded web material is arranged to be supported at the lower end portion 20.

For supporting the stack at the lower end portion 20, the web material storage section 16 comprises a support arrangement 70. For supporting the stack along the vertical direction 12, the web material storage section 16 comprises side elements 24 on four sides thereof. Accordingly, the stack of web material is arranged to be substantially enclosed in the web material storage section 16. Some of the side elements 24 may be flexible. Some side elements 24 may be provided with openings for providing access to the interior of the web material storage section 16.

The support arrangement 70 comprises two opposite supporting member 72, which are arranged to be pivotable about respective pivot axis 101 arranged at opposing sides of a loading opening 62.

Moreover, the web material storage section 16 comprises an upper stop member 100 delimiting the space available for storage of web material. In the illustrated embodiment, the upper stop member 100 is formed by a part of the housing 4. Since, in this embodiment, the web material storage section 16 is fixedly arranged to the housing, the upper stop member 100 may be thus formed.

In the variant of FIGS. 3*a* to 3*b*, the orientation of the web material storage section 16 is not altered by the dispenser moving from a dispensing position to a loading position. Instead, by opening the door 6, the dispenser will be brought to a dispensing position.

Accordingly, the web material storage section is vertically arranged both in said dispensing position, and in said loading position.

Figure 4C:
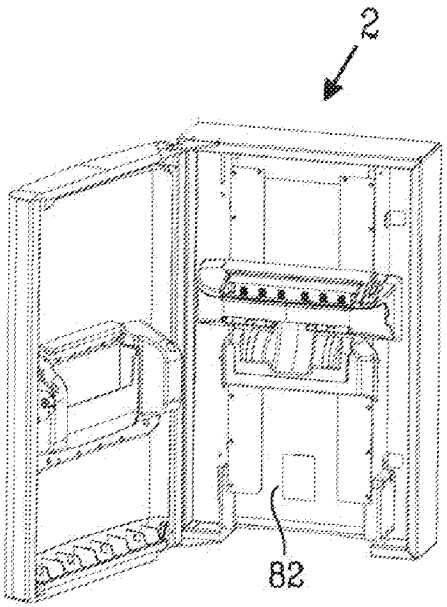
FIGS. 4*a* to 4*c* illustrate the introduction of a stack of material in the dispenser of FIGS. 3*a* and 3*b*.
Figure 4B:
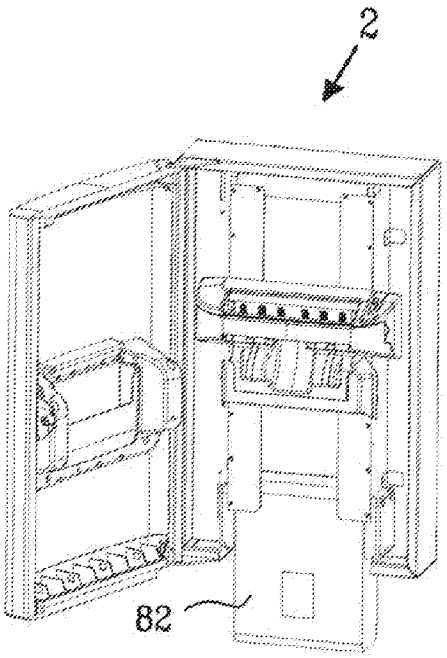
Figure 4A:
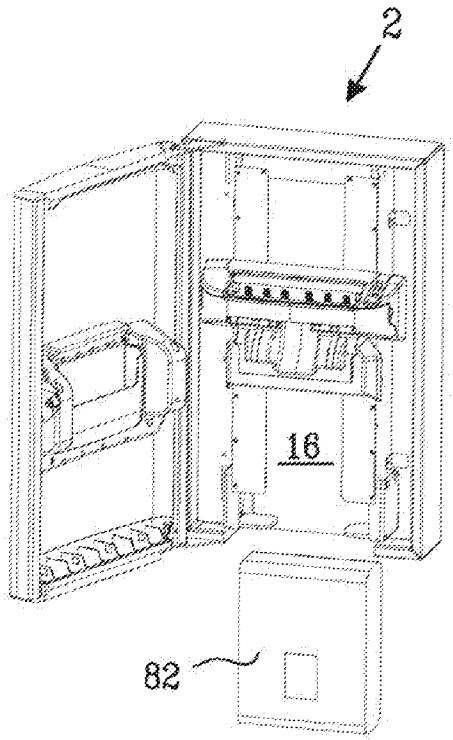

The dispenser of FIGS. 3*a* and 3*b* comprising the support arrangement 70 will hence provide the same functions as explained in relation to FIGS. 1*a* and 1*b*, 2*a*-2*d* above. FIGS. 4*a* to 4*c* illustrate the dispenser of FIGS. 3*a* and 3*b* during introduction of new web material in the form of a stack 82.

In the variant of FIGS. 3*a* and 3*b*, the web material storage section is arranged such that the spatial relationship between the lower end portion 20 and the upper end portion 18 is fixed. Moreover, the web material storage section is fixedly arranged within the housing of the dispenser, and the dispenser is moreover intended to be fixedly arranged e.g. to a wall.

Other variants where the spatial relationship between the lower end portion 20 and the upper end portion 18 of the web material storage section 16 is fixed are naturally conceivable. For example, such a web storage section may be swung out of a housing, tilted, or otherwise re-oriented in relation to the housing in order to render the loading opening 62 accessible for refill of tissue material.

In other variants of dispensers, the spatial relationship between the lower end portion 20 and the upper end portion 18 may be variable. One such variant is illustrated in FIG. 5.

Figure 5:
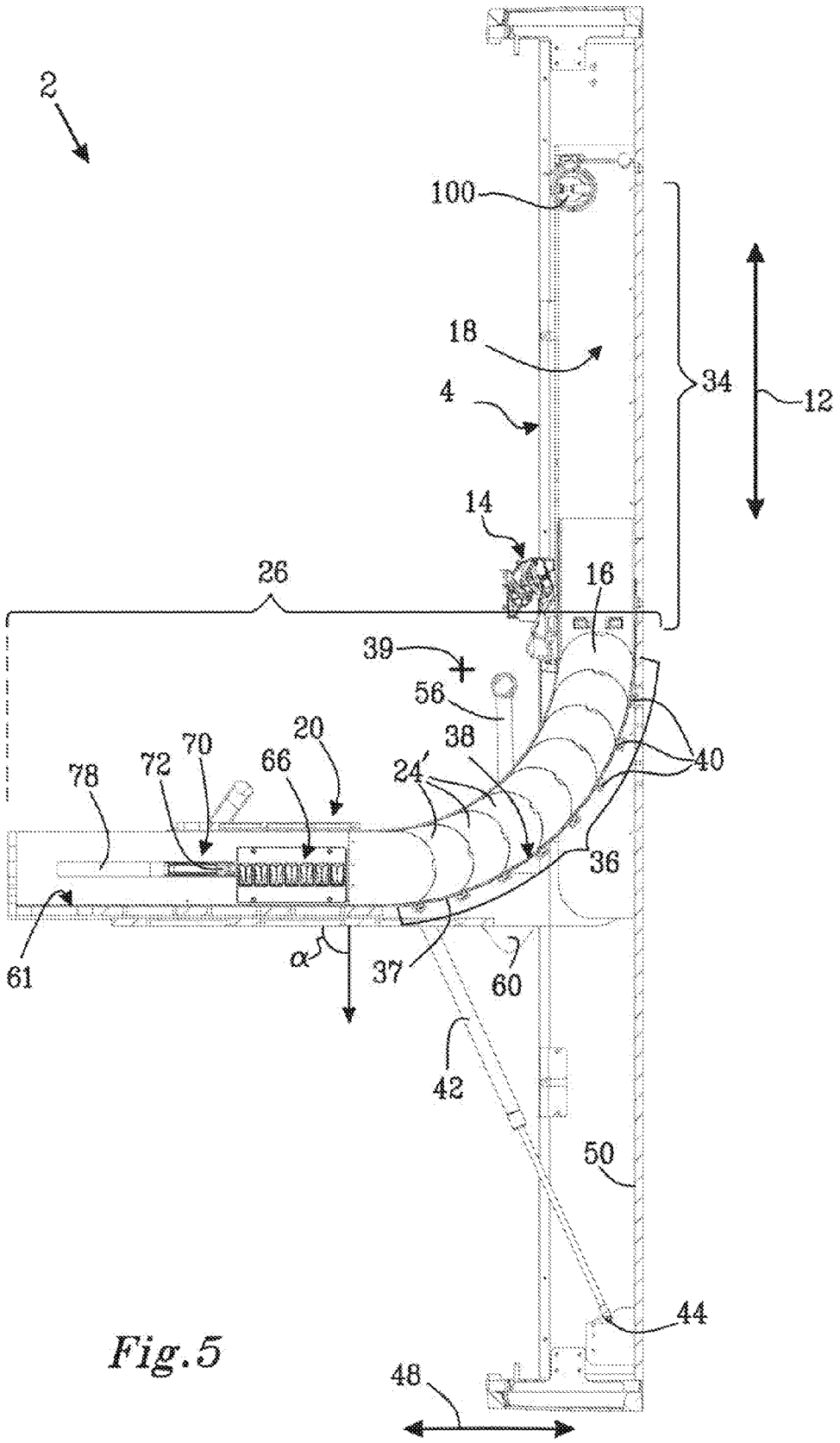
FIG. 5 illustrates another embodiment of a dispenser, which dispenser is in a loading position.

FIG. 5 illustrates a dispenser 2 for dispensing at least one sheet of web material. The dispenser 2 comprises a housing 4. The housing 4 is arranged to be positioned along a vertical direction 12. Thus, the housing 4 has natural top and bottom ends when the dispenser 2 is installed at a site for dispensing sheets of web material therefrom. The housing 4 comprises a door 6 (not shown). In the door 6, a dispensing opening 8 is provided for dispensing the sheet of web material. The door 6 is arranged to be opened and thus, to provide access to an interior of the dispenser 2, e.g. for the purpose of replenishing the dispenser 2 with packages of folded web material.

However, other variants are conceivable, where the dispenser may be refillable without need for opening a door.

The dispenser 2 is arranged for dispensing web material from a folded web material which may be Z-folded in an accordion-like manner. The web material has been omitted in FIG. 5 for clarity reasons. The dispenser 2 comprises a dispensing arrangement 14 from which web material will be fed to the dispensing opening 8 in the door 6 when the dispenser 2 is in use.

A web material storage section 16 is provided inside the housing 4. The web material storage section 16 is arranged to hold and support the folded web material. The web material storage section 16 comprises a lower end portion 20 and an upper end portion 18.

The web material storage section 16 comprises a displaceable portion 26, and a fixed portion 34. In a dispensing position (not shown), the displaceable portion 26 is arranged vertically below and substantially aligned with the fixed portion 34. The displaceable portion 26 comprises the lower end portion 20 of the web material storage section 16, and the fixed portion 34 comprises the upper end portion 18. When the displaceable portion 26 is arranged in the dispensing position, the lower end portion 20, seen along the vertical direction 12, is arranged substantially underneath the upper end portion 18. Accordingly, when the displaceable portion 26 is arranged in the dispensing position, the door 6 may be closed and users may dispense sheets of web material from the dispensing opening. At least in the dispensing position, the dispensing opening 8 is arranged above the lower end portion 20, seen along the vertical direction 12. Accordingly, at least part of a stack of web material arranged in the web material storage section 16 is arranged below the dispensing opening 8.

The dispenser 2 is arranged for dispensing from a top of the stack of folded web material. In use, a tail of the web material extends from the top of the stack of folded web material supported in the web material storage section 16 to the dispensing opening in the closed door. When the dispenser 2 has been newly replenished with folded web material, the top of the stack of folded web material may be in a region of the upper end portion 18 of the material storage section 16. Accordingly, the tail of web material extends from the upper end portion 18 to the dispensing opening 8. On the other hand, when most of the web material in the dispenser 2 has been dispensed, the top of the stack of folded web material is in a region of the lower end portion 20 of the material storage section 16. In this case the tail of web material extends through the web material storage section 16, from its lower end portion 20 to its upper end portion 18 and therefrom to the dispensing opening 8.

In order to guide the tail of web material from the web material storage section 16 towards the dispensing opening, the dispenser 2 comprises a guiding arrangement 100 arranged at the upper end portion 18 of the web material storage section 16, and the separation unit 14. Thus, the tail of web material extends upwardly from the stack of folded web material in the web material storage section 16, through the guiding arrangement 100 and via the separation unit 14 to the dispensing opening. The guiding arrangement 100 may comprise a nip arranged to frictionally engage with the tail of web material sufficient for preventing the tail of the web material from sliding downwards towards the stack of folded web material in the web material storage section 16.

The guiding arrangement 100 may, as in the illustrated embodiment, also form an upper stop member delimiting the vertical extension of the web material storage section 16. This means that folded web material cannot pass the upper stop member 100, when the web material is loaded from the lower end portion 20 of the web material storage section. Hence, the upper stop member will define the uppermost position to which stack of folded web material contained in the web material storage section 16 may extend.

The dispensing arrangement 14 may comprise a separation unit 28 adapted for separating a sheet of web material from a perforated web material.

The displaceable portion 26 is displaceable to a tilted loading position, which is illustrated in FIG. 5.

In the tilted loading position of the displaceable portion 26, the lower end portion 20 of the web material storage section 16 is positioned beside and below the upper end portion 18 of the web material storage section 16, seen along the vertical direction 12. Put differently, in the tilted loading position the lower end 20 is positioned farther away from a rear side 50 of the housing 4 than in the dispensing position, seen along the horizontal direction 48. The displaceable portion 26 is upwardly pivotable in relation to the vertical direction 12.

According to some embodiments, the displaceable portion 26 may be pivotable to an angle alfa of between 30 and 100 degrees from a downward direction along the vertical direction 12. In this manner the displaceable portion 26 is readily accessible to a user standing in front of the dispenser for replenishing the dispenser 2 with one or more packages of web material.

In the illustrated embodiment, the displaceable portion 26 is pivotable to an angle of approximately 90 degrees from the downward direction. When the displaceable portion 26 is arranged in the tilted loading position, the lower end portion 20 is easily reachable for replenishing the dispenser 2 with folded web material from a bottom end of a stack of folded web material present in the web material storage section 16.

The displaceable portion 26 further comprises a transitional portion 36 forming a transition from the displaceable portion 26 to the fixed portion 34. When the displaceable portion 26 is positioned in the tilted loading position, the transitional portion 36 forms a gradual transition from the displaceable portion 26 to the fixed portion 34.

In view of the above, it is understood that the lower end portion 20 and the upper end portion 18 are not in a fixed spatial relationship in the embodiment of FIG. 5. Instead, the lower end portion 20 and the upper end portion 18 are in a variable spatial relationship, which relationship varies when the displaceable portion 26 is moved from the generally vertical position in the dispensing position of the dispenser, to the tilted position in the loading position of the dispenser.

In FIG. 5, side elements 24 on the four sides of the web material storage section 16 support the stack of folded web material. In the transitional portion 36, one side element comprising a flexible plate 37 comprises a substantially smooth surface 38 adapted to abut against the stacks of folded web material introduced in the web storage section 16.

The flexible plate 37 is arranged towards the rear side 50 of the dispenser 2 and thus, the stack of folded web material may slide along the substantially smooth surface 38 when the stack is pushed upwardly in the web material storage section 16 as the stack is replenished from its bottom end. The flexible plate 37 is supported by at least one element 40 extending in a direction across the vertical direction 12. In the transitional portion 36, a number of side elements 24', arranged substantially perpendicularly to the flexible plate 37, are pivotably linked to each other to permit upward pivoting of the displaceable portion 26. Accordingly, a pivot axis 39 of the displaceable portion 26, seen as a whole, is arranged at a distance from the displaceable portion 26.

The displaceable portion 26 is biased towards the tilted loading position. In these embodiments the dispenser 2 comprises two gas springs 42 arranged to bias the displaceable portion 26 towards the tilted loading position. Each gas spring 42 is pivotably attached to the housing 4 at a bottom end portion of the housing 4 and to the displaceable portion 26 at a distance above the bottom end of the housing 4, approximately at a middle portion of the displaceable portion 26. A housing pivot point 44 of each gas spring 42 is arranged at the bottom end portion of the housing 4 and fixed in relation to the housing 4. A displaceable portion pivot point of each gas spring is arranged at the middle portion of the displaceable portion 26 and is movable together with the displaceable portion 26 in relation to the housing 4.

When the displaceable portion 26 is positioned in the dispensing position, the displaceable portion pivot point is arranged closer to the rear side 50 of the dispenser 2 than the housing pivot point 44, seen along the horizontal direction 48. Moreover, the gas springs 42 are compressed when the displaceable portion 26 is in the dispensing position. Thus, when the displaceable portion 26 is in the dispensing position, due to the arrangement of the housing pivot point 44 and the displaceable portion pivot point 46 in the horizontal direction 48, and the inherent property of the compressed gas springs 42 to extend, the displaceable portion 26 is held in the dispensing position. Thus, the gas springs 42 and the particular arrangement of their housing pivot points 44 and their displaceable portion pivot points 46 form a locking arrangement of the displaceable portion 26. The locking arrangement is arranged to be released to permit pivoting of the displaceable portion 26 from the dispensing position to the tilted loading position.

When in the tilted loading position, the user may replenish the dispenser 2 with stacks of folded web material via a loading opening 62 arranged in a region of the lower end portion 20. At least one of the side elements 24 of the displaceable portion 26 is provided with a support surface 61. The support surface 61 is tilted together with the displaceable portion 26 in the tilted loading position. Thus, a package of folded web material placed in the displaceable portion 26 is supported by the support surface 61 in the vertical direction 12 when the displaceable portion 26 is in the tilted loading position. The lower end portion 20 is provided with a recess 64 for removing a packaging strip of a package of folded web material. Finally, the user may pivot the displaceable portion 26 back into the dispensing position by pushing against the displaceable portion 26 at the lower end portion 20.

The gas springs 42 are thus compressed and the displaceable portion 26 is again held in the dispensing position by positioning the dispensing portion pivot point 46 closer to the rear side 50 than the housing pivot point 44, seen along the horizontal direction 48.

The displaceable portion 26 comprises a supporting arrangement 70 for, at least when the dispenser is in a dispensing position supporting at least a portion of the stack of folded web material. The supporting arrangement 70 comprises two projection members 72, one on each side of the displaceable portion 26. The supporting arrangement 70 is arranged to move between a support position and an insert position. To this end, the supporting arrangement may be e.g. as described in relation to the variants previously described herein, for example in any of the FIGS. 1 to 4.

In FIG. 5, the displaceable portion 26 comprises an outer end portion 61 extending beyond the web material storage section 16, so as to form a space adjacent the supporting arrangement, towards the bottom end 20. This may be desired in order to provide a space in which a new stack of web material may be positioned before the stack is pushed towards the supporting arrangement 70 so as to be introduced into the web material storage section 16.

However, variants are conceivable where the supporting arrangement 70 are arranged at an outermost end of the displaceable portion 26. Such variants will be advantageous in that the web material storage section 16 may make more efficient use of the space available inside the dispenser for storage of web material.

Example embodiments described above may be combined as understood by a person skilled in the art. Therefore, it is to be understood that the foregoing is illustrative of various examples and that the invention is defined only the appended claims.

As used herein, the term "comprising" or "comprises" is open-ended, and includes one 3 or more stated features, elements, steps, components or functions but does not preclude the presence or addition of one or more other features, elements, steps, components, functions or groups thereof.

The invention claimed is:

1. A dispenser for dispensing a sheet of web material from a stack of folded web material, the dispenser comprising:

a web material storage section arranged to hold and support the stack of folded web material, in a generally vertical direction during dispensing of the web material;

the web material storage section comprising an upper end portion from which the web material is arranged to be lead for dispensing thereof, a lower end portion, opposite to the upper end portion and being arranged to support the stack of folded web material in said generally vertical direction, at least when the dispenser is in said dispensing position, said upper end portion and lower end portion being arranged in a fixed spatial relationship;

wherein:

the lower end portion of the web material storage section comprises a loading opening and a supporting arrangement, arranged to be movable between a support position wherein the supporting arrangement extends at least partially over said loading opening enabling said support of the stack of folded web material, and an insert position, wherein the supporting arrangement is at least partially removed from the loading opening;

wherein said supporting arrangement is arranged to be movable from said support position to said insert position by pushing a stack to be introduced in the loading opening towards the supporting arrangement in a direction towards the upper end portion of the web material storage section.

2. A dispenser in accordance with claim 1, wherein said supporting arrangement is arranged to enable said support position to be reassumed, when said stack is pushed a distance D, along a direction towards the upper portion, from the support position of the supporting arrangement.

3. A dispenser in accordance with claim 1, wherein the supporting arrangement is arranged to automatically reassume the support position when released from the insert position.

4. A dispenser in accordance with claim 1, wherein the supporting arrangement is biased towards the support position.

5. A dispenser in accordance with claim 1 wherein said upper end portion of the web material storage section comprises an upper stop member, arranged to delimit the space available for folded web material in the web material storage section.

6. A dispenser in accordance with claim 1 wherein, when the dispenser is in said dispensing position, said loading opening and said supporting arrangement are accessible for loading of stacks into the storage section.

7. A dispenser in accordance with claim 1, wherein said supporting arrangement is the only arrangement in said web material storage section which provides support to a stack in said generally vertical direction, when the dispenser is in said dispensing position.

8. A dispenser in accordance with claim 1, wherein said supporting arrangement is the only arrangement in said web material storage section which provides support to a stack in a direction towards the upper end portion of the storage section, when the dispenser is in said loading position.

9. A dispenser in accordance with claim 1, wherein said loading opening is formed by a lowermost end of the web material storage section.

10. A dispenser in accordance with claim 1, wherein said supporting arrangement is arranged at a lowermost end of the web material storage section.

11. A dispenser in accordance with claim 1, wherein said supporting arrangement is arranged at a distance from a lowermost end of the web material storage section.

12. A dispenser in accordance with claim 1, wherein at least in the dispensing position, the dispensing opening is arranged above the lower end portion, seen along the vertical direction.

13. A method of replenishing a dispenser according to claim 1, wherein the method comprises:

placing an end surface of a stack of folded web material to abut against the supporting arrangement, pushing said stack of folded web material towards the upper end of the web storage section, so as to move the supporting arrangement from its support position to its release position;

releasing said stack when positioned beyond the supporting arrangement, allowing the return of the supporting arrangement to its support position.

14. Method according to claim 13, wherein the dispenser comprises an initial stack of web material, said initial stack and said stack comprising corresponding connector means, and said introduction of the stack adjacent the initial stack in the web storage section resulting in interconnection of the stacks via said connector means.

15. A dispenser in accordance with claim 1, wherein said supporting arrangement comprises at least one projection member.

16. A dispenser in accordance with claim 15, wherein the projection member is retractable from the support position to said insert position.

17. A dispenser in accordance with claim 2, wherein the support arrangement is arranged so as to traverse the distance D inside the storage section when moving between said support position and said insert position.

18. A dispenser in accordance with claim 2, wherein the distance D is at least 20 mm.

19. A dispenser in accordance with claim 1, wherein said supporting arrangement comprises at least one projection member.

20. A dispenser in accordance with claim 19, wherein said projection member is pivotable between said support position and said insert position.

21. A dispenser in accordance with claim 20, wherein the projection member is pivotable in a direction towards the upper end portion for moving between the support position and the insert position.

22. A dispenser in accordance with claim 1, wherein said dispenser is movable from said dispensing position to a loading position, wherein said loading opening and supporting arrangement are accessible for loading of stacks into the storage section.

23. A dispenser in accordance with claim 22, wherein said web material storage section, or at least a displaceable portion of the web material storage section, is tiltable from said dispensing position to said loading position.

24. A dispenser in accordance with claim 22, wherein, in said loading position, said storage section is arranged with said upper end portion at a location vertically above said lower end portion.

25. A dispenser in accordance with claim 22 wherein, in said loading position, said storage section, or a displaceable portion of the web material storages section, forms an angle of less than about 90 degrees with said vertical direction.

26. A dispenser in accordance with claim 1, wherein the dispenser comprises a housing, and said web material storage section is positioned inside the housing.

27. A dispenser in accordance with claim 26, wherein the displaceable portion in the tilted loading position is pivoted to an angle of between 30-100 degrees from a downward direction along the vertical direction.

28. A dispenser in accordance with claim 26, wherein the web material storage section comprises a fixed portion above the displaceable portion, seen along the vertical direction, and wherein the displaceable portion comprises a transitional portion forming a gradual transition from the displaceable portion to the fixed portion when the displaceable portion is positioned in the tilted loading position.

29. A method of replenishing a dispenser according to claim 2, wherein the method comprises:

placing an end surface of a stack of folded web material to abut against the supporting arrangement, pushing said stack of folded web material towards the upper end of the web storage section, so as to move the supporting arrangement from its support position to its insert position;

continuing pushing of said stack towards the upper end to a position a distance D from the support position, so as to enable the supporting arrangement to reassume the support position;

releasing said stack inside the web storage section, allowing the return of the supporting arrangement to its support position.

30. A dispenser for dispensing a sheet of web material from a stack of folded web material, the dispenser comprising:

a web material storage section arranged to hold and support the stack of folded web material, in a generally vertical direction when the dispenser is in a dispensing position for dispensing the web material;

the web material storage section comprising an upper end portion from which the web material is arranged to be lead for dispensing thereof, and a lower end portion, opposite to the upper end portion and being arranged to support the stack of folded web material in said generally vertical direction, at least when the dispenser is in said dispensing position, wherein:

the lower end portion of the web material storage section comprises a loading opening and a supporting arrangement, arranged to be movable between a support position wherein the supporting arrangement extends at least partially over said loading opening enabling said support of the stack of folded web material, and an insert position, wherein the supporting arrangement is at least partially removed from the loading opening;

wherein said supporting arrangement is arranged to be movable from said support position to said insert position by pushing a stack to be introduced in the loading opening towards the supporting arrangement in a direction towards the upper end portion of the web material storage section, wherein said supporting arrangement is arranged to enable said support position to be reassumed, when said stack is pushed a distance, along a direction towards the upper portion, from the support position of the supporting arrangement.

31. A dispenser in accordance with claim 30, wherein said upper end portion and lower end portion are arranged in a fixed spatial relationship.

32. A dispenser in accordance with claim 30, wherein said upper end portion and lower end portion are arranged so as to allow variation of their spatial relationship.

33. A dispenser in accordance with claim 32, wherein the web material storage section comprises a displaceable portion, the displaceable portion, wherein the lower end portion, seen along the vertical direction, is arranged substantially underneath the upper end portion when the displaceable portion is arranged in a dispensing position, and the displaceable portion is displaceable from the dispensing position to a tilted loading position, in which tilted loading position the lower end portion is positioned beside and below the upper end portion, seen along the vertical direction.

34. A dispenser in accordance with claim 33, wherein the displaceable portion is upwardly pivotable in relation to the vertical direction.

* * * * *